United States Patent [19]

Deshet

[11] Patent Number: 4,856,399

[45] Date of Patent: Aug. 15, 1989

[54] APPARATUS FOR BLANKING THIN SHEETS USING A PUNCH HAVING LOCALIZED REGIONS OF HAND AND SOFT ELASTIC MATERIAL

[75] Inventor: Gabriel Deshet, Nogent-sur-Oise, France

[73] Assignee: Isoform, Courbevoie, France

[21] Appl. No.: 195,087

[22] Filed: May 17, 1988

[30] Foreign Application Priority Data

May 22, 1987 [FR] France ..... 87 07239

[51] Int. Cl.[4] ..... B26F 1/14

[52] U.S. Cl. ..... 83/685; 83/21; 83/55; 83/542; 83/686

[58] Field of Search ..... 83/21, 55, 128, 138, 83/542, 684, 685, 686, 689, 690; 72/55

[56] References Cited

U.S. PATENT DOCUMENTS 2,133,445 10/1938 Guerin .
2,377,664 6/1945 Berger .
2,859,719 11/1958 Kraybill .
3,683,735 8/1972 Achler et al. .
3,765,285 10/1973 Achler et al. .

FOREIGN PATENT DOCUMENTS 2584956 1/1987 France .
570248 12/1975 Switzerland .

*Primary Examiner*—Frank T. Yost
*Assistant Examiner*—Scott A. Smith
*Attorney, Agent, or Firm*—Fay, Sharpe, Beall, Fagan, Minnich & McKee

[57] ABSTRACT

In an apparatus for blanking out a sheet material (1) between a punch (4) and a die (6) having a sharp edge (7), the punch (4) is formed by a heterogeneous composite elastic material having localized regions (4*a*) having a relatively higher hardness, and complementary regions (4*b*) having a relatively lower hardness.

11 Claims, 6 Drawing Sheets

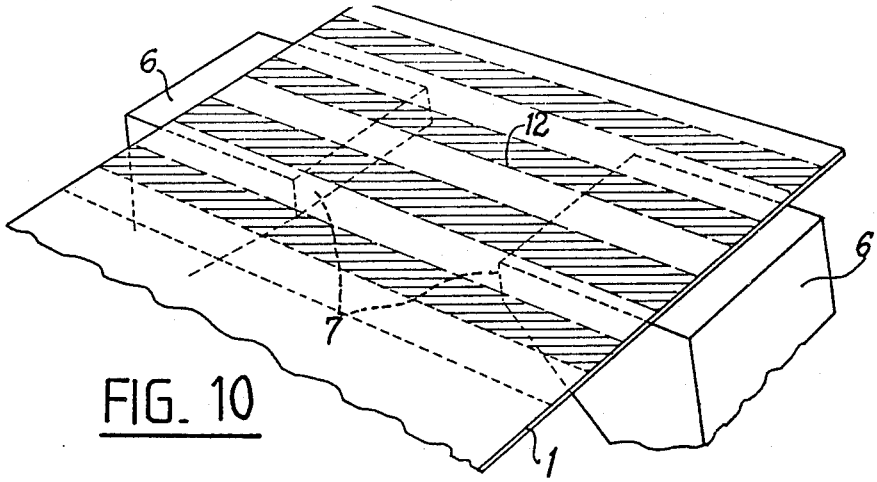
FIG. 10
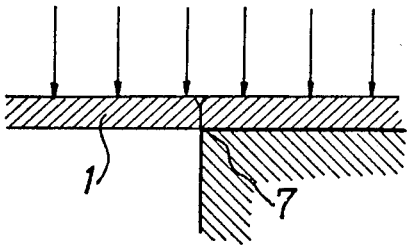
FIG.11
FIG.12
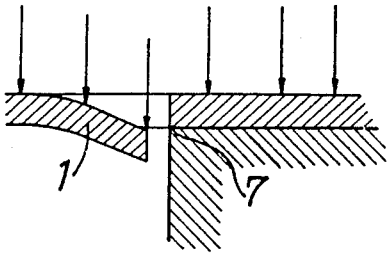
FIG.13
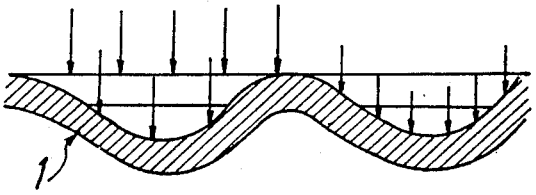

APPARATUS FOR BLANKING THIN SHEETS USING A PUNCH HAVING LOCALIZED REGIONS OF HAND AND SOFT ELASTIC MATERIAL

The present invention relates to an apparatus for blanking material in the form of a relatively thin sheet of any material, and in particular a thin metal or non-metal sheet.

The blanking out along an open or closed perimeter of sheet stock is effected on a blanking press comprising essentially a movable ram carrying a punch having a shape corresponding to the perimeter to be blanked and a fixed table on which rests the blanking die having the conjugate shape cooperating with the punch to form the desired blank.

The punch and the die are usually of metal and in particular made from tool steel for blanking metal sheets.

One of the major drawbacks of this technique resides in the necessity to adjust the operational clearances between the die and the punch with high precision in order to avoid burrs. It is indeed considered in practice that the allowable clearance must not be more than one tenth of the thickness of the part to be blanked. It is therefore obvious that this tolerance is extremely difficult to conform to in industrial plants, or at least at acceptable costs for extra-thin sheets having a thickness less than 0.5 mm. Moreover, the maintenance cost increases with decrease in the allowable tolerances.

The object of the present invention is to overcome these drawbacks by providing a blanking method which is cheaper and yet avoids the problems of the formation of burrs.

The invention therefore provides an apparatus for blanking a sheet material between a punch and a die having a sharp edge wherein the punch is formed by a heterogenous composite elastic material having localized regions having relatively higher hardness and complementary regions having relatively lower hardness.

The heterogeneous composite elastic material is formed by an elastic mass having a given hardness including a structure composed of an elastic material having a different hardness defining a meshing for inducing differenciated stresses on the surface of the sheet to be blanked.

According to a variant, the heterogeneous composite elastic material comprising in alternating relation regions constituted by an elastomer contiguous to empty regions.

According to another variant, the heterogeneous composite elastic material is formed by a hollow waffled structure having a given hardness defining cavities filled with a material having a different hardness.

The waffled structure comprises on the whole of its surface opposed to the active working surface an elastic distributing mass.

According to other variants:

the hardness of the distributing mass is relatively low;

the waffled structure has closed cavities;

the waffled structure has open cavities communicating with the distributing mass;

the walls of the cavities are hard and the rest is soft.

According to another variant, the structure is embedded in the elastic mass and is constituted by a material having a given hardness defining a crossing network having a suitable meshing. This structure may be in particular in the form of a grille or lattice.

The invention also concerns a heterogeneous composite elastic material of utility for carrying out the method defined hereinbefore. This material is in particular in the form of an elastic cushion.

The material from which this cushion is made may be in particular an elastomer such as silicone polymer or an elastomeric polymer such as polyurethane. The heterogeneous composite elastomeric material may be wrapped in an outer skin serving as a protection.

The apparatus according to the invention is based on the fact that the heterogeneity of the mass of elastic material enables the stresses to be concentrated along localized lines corresponding to the coincidence of the regions of high hardness with the sharp edge of the die. This concentration initiates the blanking operation by cracking at the point of origin, fracture and propagation of the cut initiated by another heterogeneous region.

The elastomeric cushion is formed by a mass of material having a given hardness in which is embedded a material of higher hardness, for example in the form of a network of crossing veins defining a meshing similar to a grille or grilling. In this case, the regions of relatively higher hardness are included in the mass of the material having a relatively lower hardness.

According to a variant described herein before waffled structure), the elastomeric cushion may be similar to a honeycomb structure whose cavities are filled with a material of relatively low hardness. The honeycomb structure, i.e. the alveolate structure, may be designed in such manner that the regions having a relatively higher hardness open onto or do not open onto the surface.

The heterogeneous structure may comprise an elastic distributing mass, i.e. a distributing elastomeric sublayer on the side facing the punch, transmitting the force of the latter to the whole of the heterogeneous structure which is placed on the sheet, itself in contact with the sharp edges of the metal die defining the regions to be blanked.

As the essential feature of the invention resides in the alternation of regions of different hardnesses, the hard regions may be symmetrically reversed with the soft regions.

The following description, with reference to the accompanying drawings, will explain how the invention can be carried out. In these drawings:

FIGS. 10 to 13 illustrate diagrammatically the pressure induced by the press on a sheet and the distribution of the forces as a function of the punch according to the invention;

Figure 1:
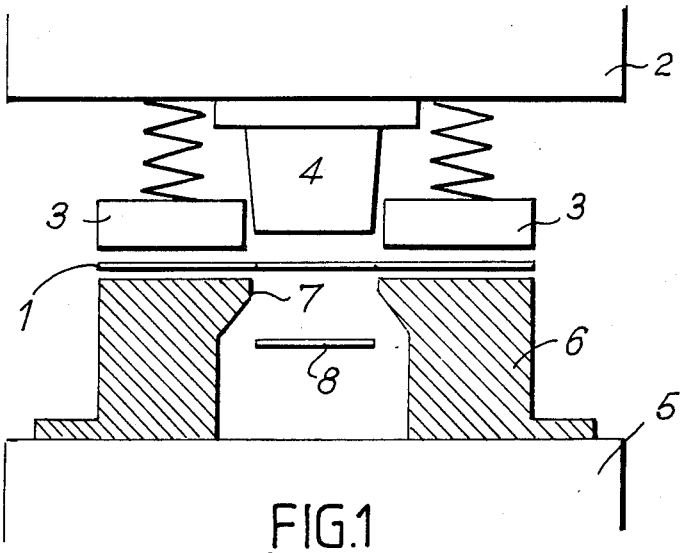
FIG.1 (PRIOR ART)
FIG. 1 is a diagrammatic elevational view of a conventional sheet blanking device.

The conventional sheet blanking device shown in FIG. 1 comprises a press which may be used for blanking a sheet 1. This press comprises, on one hand, a movable ram 2 carrying the blank holder 3 and a punch 4 having a shape corresponding to the perimeter to be blanked out, and, on the other hand, a fixed table 5 on which bears a die 6 having sharp edges 7 having the conjugate shape cooperating with the punch 4 for obtaining a blanked out sheet 8.

Figure 2:
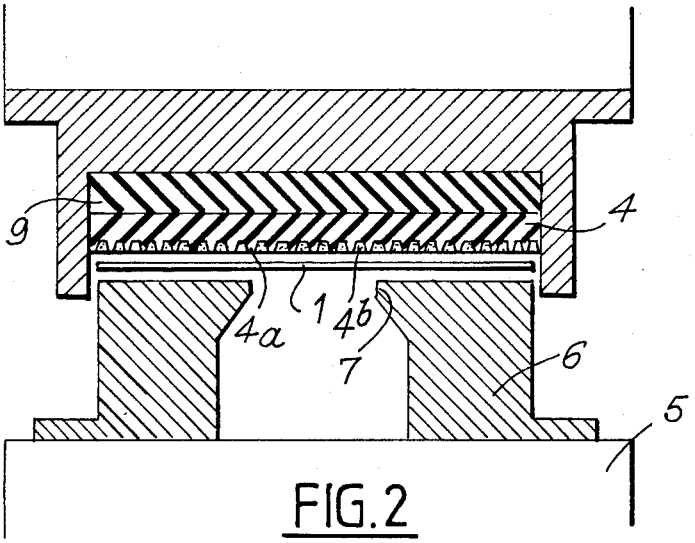
FIG. 2 is a diagrammatic sectional view of a sheet blanking device according to the invention.

The sheet blanking device according to the invention shown in FIG. 2 is likewise a press which may be used for blanking out a sheet 1 and essentially comprising, in addition to the die 6 having sharp edges 7, a movable ram 2 carrying a punch 4.

The punch 4 is constituted by a heterogeneous elastic material having localized regions **4*a* having a relatively higher hardness and complementary regions 4*b* having a relatively lower hardness. This heterogeneous structure forming a punch includes, on the side opposed to the active surface of the punch, an elastic distributing mass 9 which is a sublayer of elastomer and which transmits the force of the punch to the whole of the heterogeneous structure which is placed on the sheet, the latter being in contact with the sharp edges 7 of the metal die defining the regions to be blanked. The materials from which the heterogeneous structure 4 and the distributing mass 9** are made may be in particular an elastomer such as a silicone polymer or an elastomeric polymer such as polyurethane.

Figure 3:
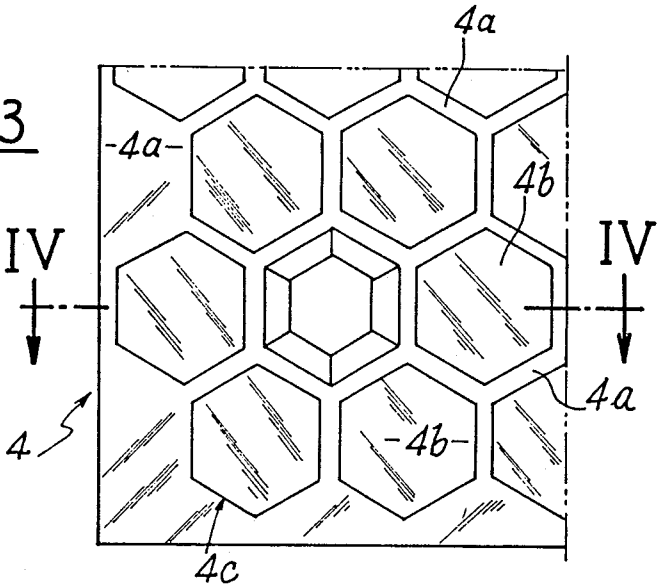
FIG. 3 is a partial top plan view of the punch of heterogenous composite elastomeric material according to the invention.
Figure 4:
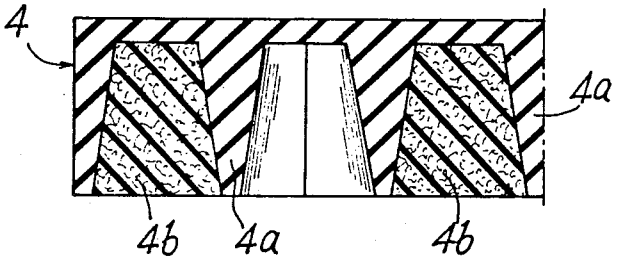
FIG. 4 is a sectional view taken on line 4—4 of FIG. 3.
Figure 5:
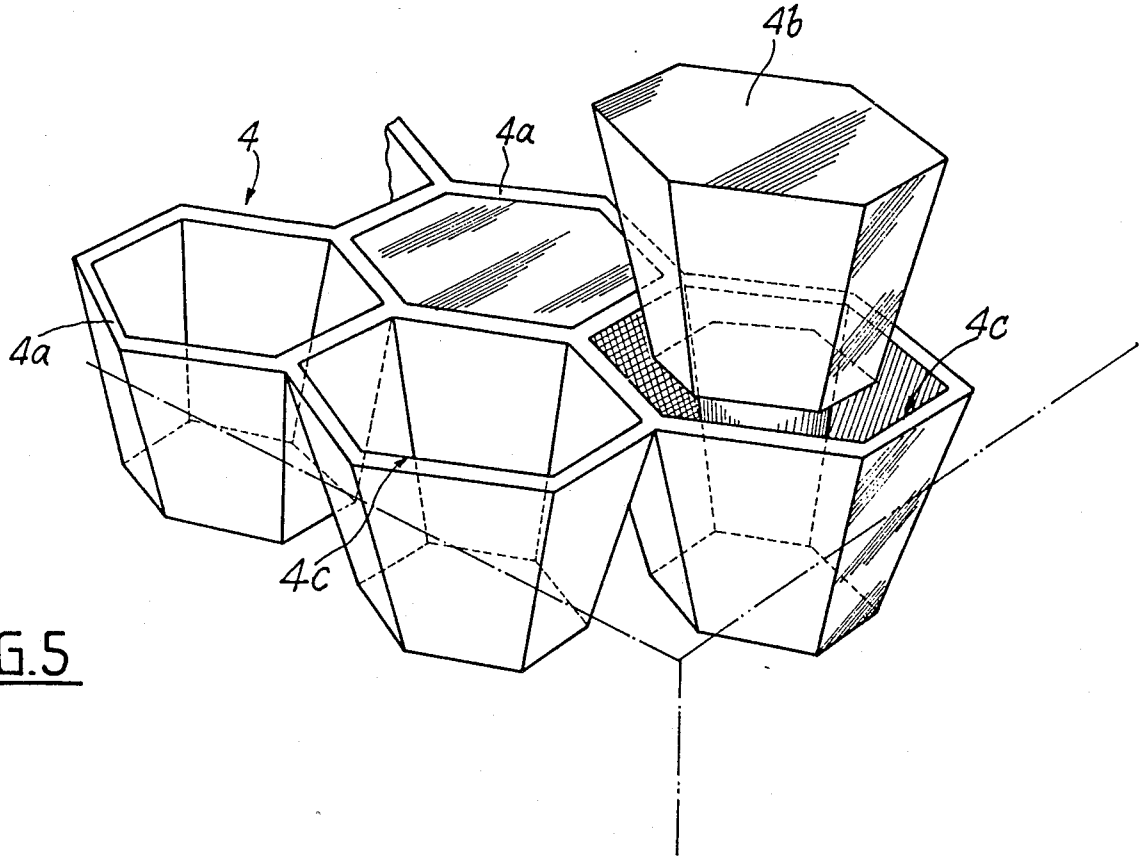
FIG. 5 is a partial perspective view of the punch according to the invention.

As shown in FIGS. 3 to 5, the heterogeneous composite elastic material constituting the punch 4 is similar to a waffled honeycomb structure defining a meshing and including a mass **4*a* of a material having a higher hardness in which are formed alveoles 4*c* filled with the material having a relatively lower hardness 4*b*. Consequently, the walls of the alveoles 4*c*** are hard and the interior of the alveoles is soft.

In order to show the shape of the alveoles **4*c*, there have been shown in FIGS. 3 to 5** empty alveoles and filled alveoles, in this embodiment the whole of the alveoles is filled with the relatively lower hardness material.

In these Figures, the alveoles **4*c*** have the shape of a frustum of a pyrimid having six sides, but they may have another shape, for example a cylindrical shape or a frustoconical shape.

Figure 6:
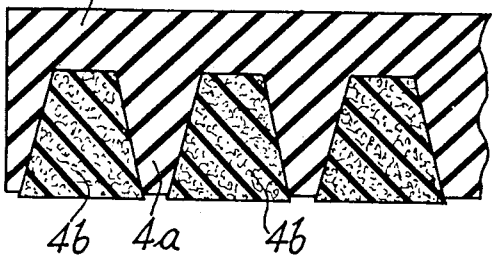
FIGS. 6 and 7 are respectively partial sectional views of two variants of the alveolate structure of the punch.
Figure 7:
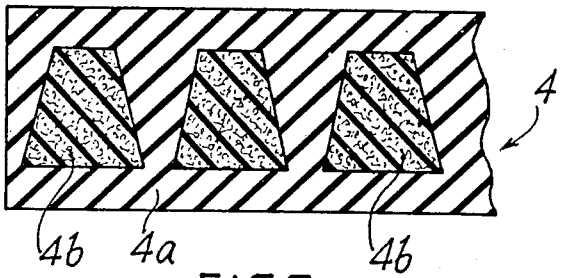

This honeycomb structure, i.e. alveolate structure, may be so designed that the regions **4*b* having a relatively lower hardness open onto or do not open onto the active surface, as shown respectivley in FIGS. 4 and 6. The regions 4*b* having a relatively lower hardness may also be included in the middle of the mass of the material 4*a* of relatively higher hardness (FIG. 7**).

Furthermore, the waffled structure of the punch 4 may have closed alveoles **4*c* or open alveoles 4*c* communicating with the distributing mass 9**.

These alveoles may also be empty so as to form a heterogenous composite elastic material comprising an alternation of regions formed by an elastomer contiguous to empty regions.

Figure 8:
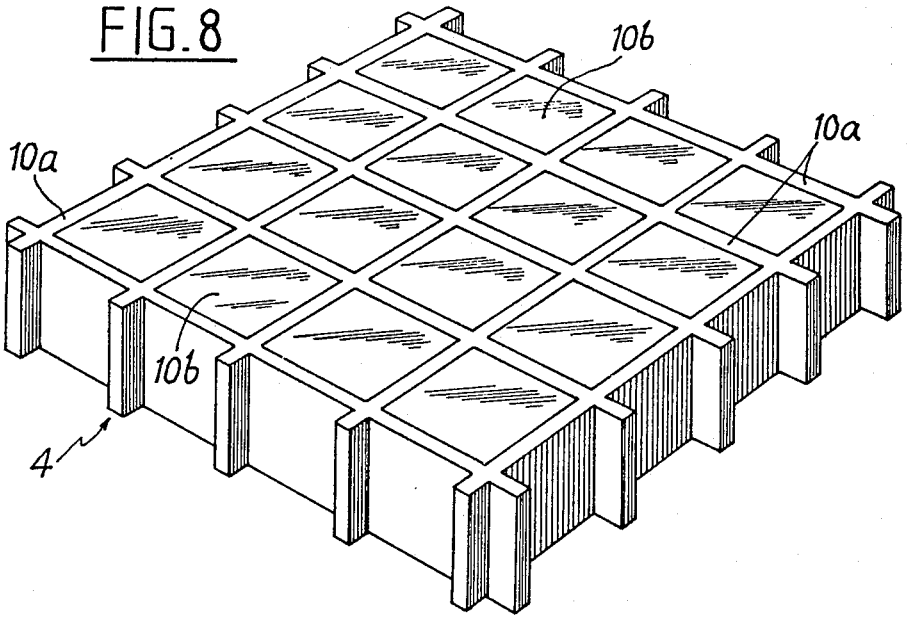
FIGS. 8 and 9 are respectively diagrammatic perspective views of two variants of the punch of a heterogeneous composite elastic material according to the invention.

According to a variant shown in FIG. 8, the heterogeneous composite elastic material constituting the punch 4 has a waffled structure in the form of hollows also including regions having higher hardness **10*a* and regions having lower hardness 10*b* which define a crossing network having a suitable meshing. In this case, the regions 10*b*** may be empty.

Figure 9:
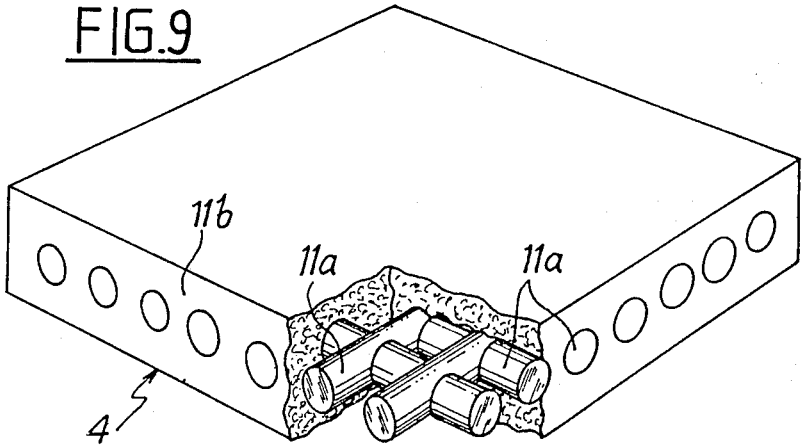

According to another variant shown in FIG. 9, the heterogeneous composite elastic material constituting the punch 4 is formed by a mass **11*b* of a material having a lower hardness in which are embedded regions 11*a*** having a higher hardness defining a meshing similar to a grille or grilling.

The heterogeneity of the mass of elastic material forming the punch 4 enables the stresses to be concentrated along localized lines 12, as diagrammatically shown in FIG. 10 corresponding to the coincidence of the high hardness regions with the sharp edge 7 of the die 6.

FIGS. 11 to 13 show that this concentration initiates the blanking operation by a cracking at the point of origin, fracture and propagation of the blanking operation by a shearing up to the meeting with another line of progression of the blanking operation initiated by another region of heterogeneity. More precisely, FIG. 11 shows the cracking by concentration of the stress of the sheet 1 against the sharp edge 7 of the die 6, FIG. 12 shows the blanking operation on the sharp edge 7, and FIG. 13 in the progression of the blanking operation by a shearing effect.

Figure 14:
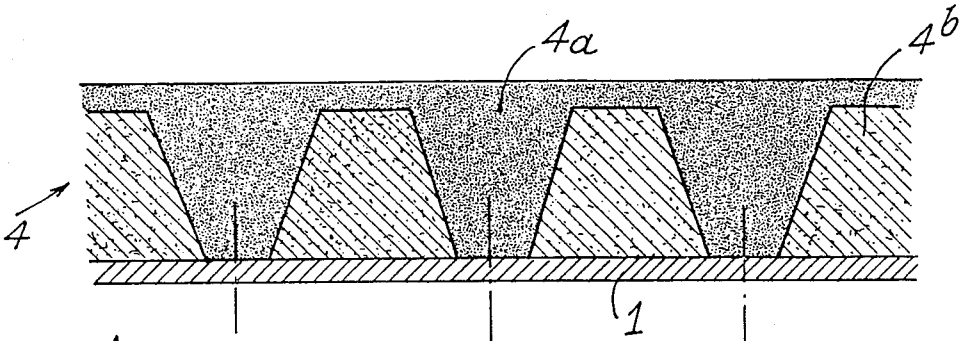
FIGS. 14 and 15 are respectively a section of the punch on a sheet and a corresponding diagram of the distribution of the stresses.
Figure 15:
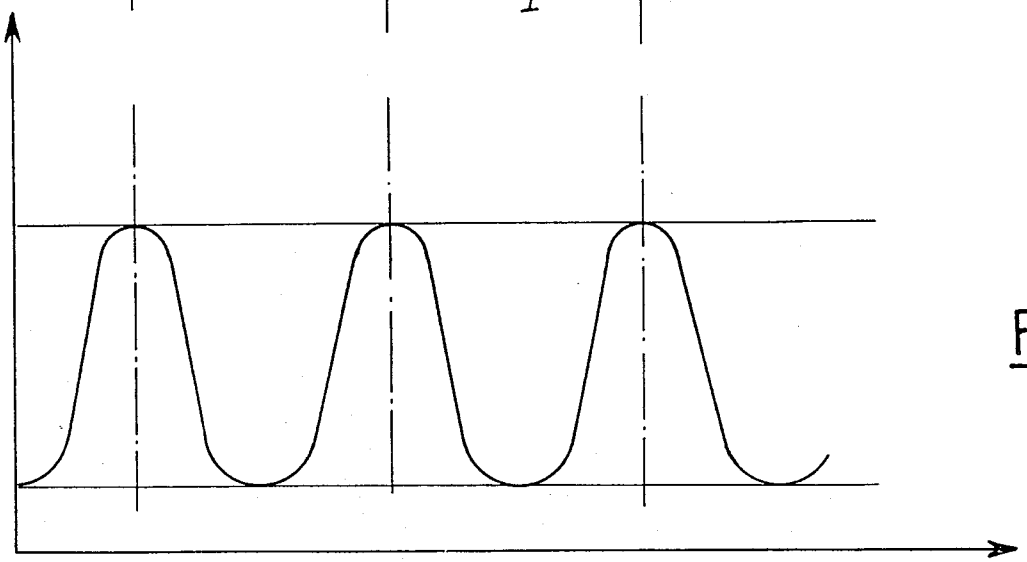

FIG. 14 shows the heterogeneous composite elastic material forming the punch 4 and including regions **4*a* of higher hardness and regions 4*b* of lower hardness on a sheet 1, while the corresponding FIG. 15 shows diagrammatically the distribution of the stresses exerted on the sheet 1 as a function of the regions 4*a*** of higher hardness in the form of a diagram representing their variations.

As the essential feature of the invention resides in the alteration of the regions of different hardnesses, the hard regions and soft regions may be reversed.

I claim:

1. An apparatus for blanking out a sheet of material between a punch and die, said die having a sharp edge, said punch comprising a heterogeneous composite elastic material having localized regions having a relatively higher hardness and complementary regions having a relatively lower hardness for inducing differentiated stresses on the surface of the sheet to be blanked.

2. An apparatus according to claim 1, wherein the heterogeneous composite elastic material comprises an elastic mass having a given hardness including a structure of an elastic material having a different hardness defining a meshing.

3. An apparatus according to claim 1, wherein the heterogeneous composite elastic material comprises an alternation of regions constituted by an elastomer contiguous to empty regions.

4. An apparatus according to claim 2, wherein the heterogeneous composite elastic material comprises a waffled structure having a given hardness and defining alveoles filled with a material of different hardness.

5. An apparatus according to claim 4, wherein the waffled structure comprises on the whole of its surface opposed to the active working surface an elastic distributing mass.

6. An apparatus according to claim 5, wherein the hardness of the distributing mass is relatively low.

7. An apparatus according to claim 4, wherein the waffled structure has closed alveoles.

8. An apparatus according to claim 4, wherein the waffled structure has open alveoles communicating with the distributing mass.

9. An apparatus according to claim 4, wherein the alveoles have hard walls and the rest is soft.

10. An apparatus according to claim 1, wherein the structure is embedded in the elastic mass and formed by a material having a given hardness and defining a crossing network having suitable meshing.

11. An apparatus according to claim 10, wherein the structure is in the form of a grille.

* * * * *

UNITED STATES PATENT AND TRADEMARK OFFICE

CERTIFICATE OF CORRECTION

PATENT NO. : 4,856,399

DATED : August 15, 1989

INVENTOR(S) : Gabriel De Smet

It is certified that error appears in the above-identified patent and that said Letters Patent is hereby corrected as shown below:

Title page, column 1, line 2, please change "Deshet" to --De Smet--.

Title page, column 1, line 7, please change "Deshet" to --De Smet--.

Signed and Sealed this

Thirty-first Day of July, 1990

*Attest:*

*Attesting Officer*

HARRY F. MANBECK, JR.

*Commissioner of Patents and Trademarks*